US010486231B2

(12) United States Patent
Morinaka et al.

(10) Patent No.: US 10,486,231 B2
(45) Date of Patent: Nov. 26, 2019

(54) SILVER-COATED COPPER POWDER

(71) Applicant: Mitsui Mining & Smelting Co., Ltd., Tokyo (JP)

(72) Inventors: Hiroyuki Morinaka, Hiroshima (JP); Kentaro Ochi, Hiroshima (JP)

(73) Assignee: Mitsui Mining & Smelting Co., Ltd., Tokyo (JP)

( * ) Notice: Subject to any disclaimer, the term of this patent is extended or adjusted under 35 U.S.C. 154(b) by 0 days.

(21) Appl. No.: 15/747,963

(22) PCT Filed: Aug. 17, 2016

(86) PCT No.: PCT/JP2016/073963

§ 371 (c)(1),
(2) Date: Jan. 26, 2018

(87) PCT Pub. No.: WO2017/038465

PCT Pub. Date: Mar. 9, 2017

(65) Prior Publication Data

US 2018/0354033 A1 Dec. 13, 2018

(30) Foreign Application Priority Data

Aug. 31, 2015 (JP) ..... 2015-169968

(51) Int. Cl.
*B22F 1/00* (2006.01)
*B22F 1/02* (2006.01)
(Continued)

(52) U.S. Cl.
CPC ..... *B22F 1/025* (2013.01); *B22F 1/0007* (2013.01); *B22F 1/0011* (2013.01); *B22F 1/0088* (2013.01); *C22C 9/00* (2013.01); *B22F 2001/0066* (2013.01); *B22F 2301/10* (2013.01); *B22F 2301/255* (2013.01); *B22F 2301/40* (2013.01); *B22F 2303/30* (2013.01); *B22F 2304/058* (2013.01); *B22F 2304/10* (2013.01); *B22F 2998/10* (2013.01); *B22F 2999/00* (2013.01); *C25C 1/12* (2013.01); *C25C 5/02* (2013.01); *H01B 1/02* (2013.01); *Y10T 428/12181* (2015.01)

(58) Field of Classification Search
None
See application file for complete search history.

(56) References Cited

FOREIGN PATENT DOCUMENTS

JP 1-247584 10/1989
JP 2000-248303 9/2000
(Continued)

OTHER PUBLICATIONS

International Search Report, PCT/JP2016/073963, dated Oct. 25, 2016.

*Primary Examiner* — Daniel J. Schleis
(74) *Attorney, Agent, or Firm* — Young & Thompson

(57) ABSTRACT

A novel silver-coated copper powder, particularly a silver-coated copper powder particle having a dendritic shape, having increased electrical conductivity with no need to increase the silver content is provided. The silver-coated copper powder is composed of a silver-coated copper particle coated with a silver layer containing silver or a silver alloy, including a silver-coated copper particle having a dendritic shape, containing nitrogen (N) in the silver layer, and having a nitrogen (N) content of 0.2 to 10.0 parts by mass with respect to 100 parts by mass of the silver content.

20 Claims, 1 Drawing Sheet

STEM-EDS mapping

STEM cross-section | nitrogen (N) mapping | silver (Ag) mapping

(51) Int. Cl.

| | |
|---|---|
| ***C22C 9/00*** | (2006.01) |
| *H01B 1/02* | (2006.01) |
| *C25C 5/02* | (2006.01) |
| *C25C 1/12* | (2006.01) |

(56) References Cited

FOREIGN PATENT DOCUMENTS

| | | |
|---|---|---|
| JP | 2006-161081 | 6/2006 |
| JP | 2008-106368 | 5/2008 |
| JP | 2012-153967 | 8/2012 |
| JP | 2013-089576 | 5/2013 |
| JP | 2013-100592 | 5/2013 |
| JP | 2015-105406 | 6/2015 |

STEM-EDS mapping
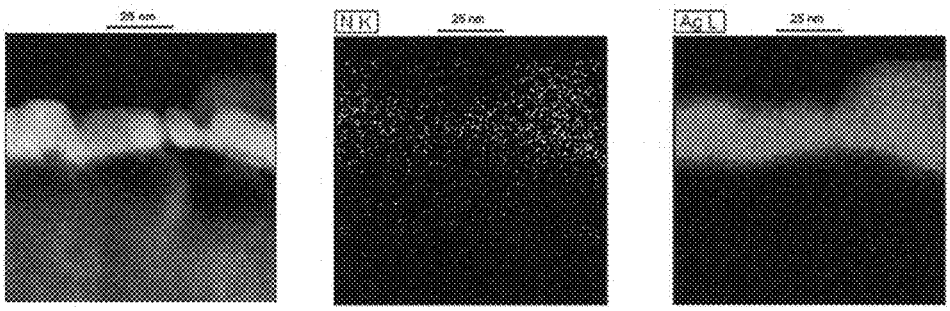
STEM cross-section
nitrogen (N) mapping
silver (Ag) mapping

SILVER-COATED COPPER POWDER

TECHNICAL FIELD

This invention relates to a silver-coated copper powder suited for use as an electrically conductive material, such as conductive paste.

BACKGROUND ART

Conductive paste is a flowable composition composed of a vehicle including a resin binder and a solvent and conductive powder dispersed in the vehicle. It is widely used in the formation of, e.g., electrical circuits, external electrodes of ceramic capacitors, electromagnetic shielding films, and bonding films.

Conductive pastes of that kind are classified into a resin curing type a resin of which cures to cause conductive powder to be compacted to secure electrical connection and a baking type which is baked to cause an organic component to vaporize and conductive powder to be sintered thereby to secure electrical connection.

The former type, resin curing type conductive paste, is a pasty composition usually made up of a conductive powder containing metal powder and an organic binder containing a thermosetting resin, such as an epoxy resin. Upon heat application, the thermosetting resin cures and shrinks together with the conductive powder, whereby the conductive powder particles are compacted in the resin matrix and brought into contact with one another to establish electrical connection. Because the resin curing type conductive paste is processable in a relatively low temperature range of from 100° C. to 200° C. at the highest and less likely to cause great thermal damage, it finds main application in printed wiring boards, thermally sensitive resin substrates, electromagnetic shielding films, bonding films, and the like.

On the other hand, the latter type, baking type conductive paste, is a pasty composition usually made up of a conductive powder (metal powder) and a glass frit dispersed in an organic vehicle. On baking at 500° to 900° C., the organic vehicle vaporizes, and the conductive powder is sintered to establish electrical connection. The glass fit serves to secure the formed conductive film to the substrate, and the organic vehicle acts as an organic liquid medium that makes the metal powder and the glass frit printable.

While the baking type conductive paste may not be used in printed wiring boards or resin materials on account of the high baking temperature, it forms an integral metal layer on sintering to achieve reduced electrical resistance and is therefore used to make, for example, an external electrode of laminated ceramic capacitors.

Since silver has high conductibility, it is widely used as a main constituent material of various conductive materials, such as anisotropic conductive film, conductive paste, and conductive adhesive. For example, a conductive paste prepared by mixing silver powder with a binder and a solvent may be printed on a substrate in a circuit pattern and baked to form an electrical circuit of a printed wiring board or an electronic component.

However, because silver is very expensive, a conductive powder called a silver-coated powder, which is obtained by plating core particles with a noble metal, has been developed and used. For example, Patent Literature 1 below discloses a silver compound-coated copper powder composed of silver-coated core copper particles coated with a silver compound selected from silver oxide, silver carbonate, and an organic acid salt of silver. The silver compound-coated copper powder has an SSA of 0.1 to 10.0 $m^3/g$ and a D50 of 0.5 to 10.0 μm and contains 1 wt % to 40 wt % of the silver compound on its surface.

Techniques for coating copper particles with silver include reductive plating and displacement plating.

Reductive plating is a process in which fine particles of silver resulting from reduction with a reducing agent are deposited densely on the surface of copper particles. For example, the method for producing silver-coated copper powder disclosed in Patent Literature 2 below comprises causing metallic copper powder and silver nitrate to react with each other in an aqueous solution having a reducing agent dissolved therein.

Displacement plating is the deposition of metallic silver resulting from reduction of silver ions each gaining an electron from metallic copper on the interface with copper particles, with the metallic copper, on the other hand, being oxidized to copper ions, thereby to replace the surface layer of the copper particles with a silver layer. For example, Patent Literature 3 below discloses a method for producing silver-coated copper powder in which silver is deposited on the surface of copper particles as a result of displacement reaction between silver ions and metallic copper in an organic solvent-containing solution in which silver ions are present.

With regard to silver-coated copper powder per se, Patent Literature 4 below proposes a dendritic conductive powder composed of copper particles having a silver layer on their surface and having a silver content of 3.0 to 30.0 mass % relative to the whole dendritic conductive powder.

Patent Literature 5 below proposes a silver-coated copper powder comprising dendritic silver-coated copper particles having copper particles of which surface is coated with silver and characterized by having a ratio of a BET specific surface area (a specific surface area measured by the BET one-point method) to a sphere-approximated specific surface area (a specific surface area determined using a laser diffraction particle size distribution analyzer) of 6.0 to 15.0.

Patent Literature 6 below discloses a silver-coated copper powder comprising silver-coated copper particles composed of copper particles coated with silver, which is characterized by having a dendritic shape with one main stem and a plurality of branches branched off obliquely from the main stem and grown two-dimensionally or three-dimensionally, the main stem having a thickness a of 0.3 μm to 5.0 μm, and the longest branch having a length b of 0.6 μm to 10.0 μm, as observed under a scanning electron microscope (SEM).

CITATION LIST

Patent Literature

Patent Literature 1: JP 2008-106368A
Patent Literature 2: JP 2000-248303A
Patent Literature 3: JP 2006-161081A
Patent Literature 4: JP 2012-153967A
Patent Literature 5: JP 2013-89576A
Patent Literature 6: JP 2013-100592A
Patent Literature 7: JP 1-247584A

SUMMARY OF INVENTION

Technical Problem

In the field of conductive paste and conductive film, finer patterning and smaller thickness having been sought, and conductive materials used in this field have been required to have smaller particle sizes. Nevertheless, because silver-coated copper powder, especially dendritic silver-coated copper powder has a markedly increased specific surface area with a smaller particle size, there arises a problem that an increase in conductivity is difficult to achieve unless the silver content per unit specific surface area is considerably increased.

Accordingly, the invention relates to a silver-coated copper powder, particularly a dendritic silver-coated copper powder and provides a novel silver-coated copper powder having increased conductivity with no need to considerably increase the silver content per unit specific surface area.

Solution to Problem

The present invention provides a silver-coated copper powder composed of a silver-coated copper particle having a surface thereof coated with a silver layer containing silver or a silver alloy, having a silver-coated copper particle having a dendritic shape, containing nitrogen (N) in the silver layer, and having a nitrogen (N) content of 0.2 parts by mass to 10.0 parts by mass with respect to 100 parts by mass of the silver content.

Advantageous Effects of Invention

The silver-coated copper powder according to the invention has a structure composed of copper particles each being covered with a silver layer containing silver or a silver alloy, includes dendritic silver-coated copper particles, and contains nitrogen (N) in the silver layer. The silver-coated copper powder of the invention is characterized in that the dendritic silver-coated copper powder exhibits increased conductivity with no need to considerably increase the silver content per unit specific surface area. Therefore, the silver-coated copper powder of the invention is particularly effective as a material of conductive paste and the like.

BRIEF DESCRIPTION OF DRAWINGS

The FIGURE shows an STEM image and STEM-EDS elemental mapping of the sample (dendritic silver-coated copper powder) obtained in Example 3, of which the left is an STEM cross-section, the middle is the nitrogen (N) mapping, and the right is the silver (Ag) mapping.

DESCRIPTION OF EMBODIMENTS

An embodiment for carrying out the invention will be described in detail. It should be understood that the invention is not construed as being limited to the embodiment.

I. Silver-coated Copper Powder

The silver-coated copper powder of the embodiment has a structure composed of copper particles having the surface thereof covered with a silver layer containing silver or a silver alloy, and includes dendritic silver-coated copper particles as main particles.

Shape of Silver-coated Copper Powder

The silver-coated copper particles as the main particles of the silver-coated copper powder of the embodiment is characterized by having a dendritic shape.

As will be demonstrated in Examples and Comparative Examples given later, it has been ascertained that silver-coated copper powder containing dendritic silver-coated copper particles as main particles (hereinafter simply referred to as dendritic silver-coated copper powder) has increased conductivity when a predetermined amount of nitrogen (N) is present in the silver layer. In the case of silver-coated copper powder containing spherical silver-coated copper particles as main particles, it has been confirmed that the presence of a predetermined amount of nitrogen (N) in the silver layer brings about no increase in conductivity. When the main particles of the silver-coated copper powder are dendritic, the powder has an increased number of contact points between particles thereby to establish a good electrical connection. When the conductive powder particles composing, e.g., conductive paste are dendritic, the number of contact points between particles increases as compared with spherical particles, so that electrical conduction characteristics may be enhanced even with a reduced amount of the conductive powder.

As used herein, the term "dendritic" means having a single main stem and a plurality of branches branched off vertically or obliquely from the main stem and grown two-dimensionally or three-dimensionally as observed under an electron microscope at a magnification of 500 to 20,000. As used herein, the term "main stem" refers to the rod-like basal part that a plurality of branches grow from.

As used herein, the term "main particles" is intended to mean those particles that account for at least 50%, preferably 70% or more, more preferably 80% or more, even more preferably 90% or more, of the total number of the particles composing the silver-coated copper powder of the embodiment. The proportion of specific particles in the total number of the particles composing a silver-coated copper powder may be determined by observation using an electron microscope at a magnification of 500 to 20,000.

Silver Layer The silver layer of the silver-coated copper powder of the embodiment preferably contains nitrogen (N). It is particularly preferred that nitrogen (N) be present in the silver layer in such a manner that the nitrogen (N) is observed to be dispersed in the silver layer when confirmed by STEM-EDS mapping.

Making a predetermined amount of nitrogen (N) be present in the silver layer, preferably dispersively, may be accomplished by an exemplary but not exclusive method including attaching a nitrogen-containing surface treating agent having an azo group to the surface of copper particles and forming a silver layer containing silver or a silver alloy on the surface of copper particles by displacement plating.

Nitrogen Content

The silver-coated copper powder of the embodiment preferably has a nitrogen (N) content of 0.2 parts by mass to 10.0 parts by mass with respect to 100 parts by mass of the silver content. It is more preferred that most of, specifically 90% or more of, the total nitrogen (N) present in the silver-coated copper powder of the embodiment be present in the silver layer.

In the case of the dendritic silver-coated copper powder, it has been ascertained that the conductivity increases without increasing the silver content when the silver layer has the above range of nitrogen (N) content.

From this viewpoint, the silver-coated copper powder of the embodiment preferably has a nitrogen (N) content of 0.2 parts by mass to 10.0 parts by mass, more preferably 0.3 parts by mass or more or 8.0 parts by mass or less, even more preferably 0.5 parts by mass or more or 5.0 parts by mass or less, with respect to 100 parts by mass of the silver content.

Silver Content

The silver-coated copper powder of the embodiment preferably has a silver content (the amount of silver coating) of 0.5 mass % to 25.0 mass % relative to the total mass of the silver-coated copper powder. With a silver content of 0.5 mass % or more relative to the total mass of the silver-coated copper powder, the powder particles, when overlapped, come into contact on their silver layers to ensure electrical conductivity. With a silver content of 25.0 mass % or less, the increase in cost with increase in silver content is minimized. From these viewpoints, the silver content is preferably 0.5 mass % to 25.0 mass %, more preferably 3.0 mass % or more and 20.0 mass % or less, even more preferably 5.0 mass % or more and 15.0 mass % or less, still even more preferably 12.0 mass % or less, based on the total mass of the silver-coated copper powder.

Silver Content Per Unit Specific Surface Area

The silver-coated copper powder of the embodiment preferably has a silver content (the amount of silver coating) per unit specific surface area of 0.2 mass %·g/m$^2$ to 40.0 mass %·g/m$^2$.

The dendritic silver-coated copper powder of the embodiment is characterized by providing increased conductivity with no need to considerably increase the silver content per unit specific surface area. While the silver content per unit specific surface area of the silver-coated copper powder of the embodiment could be 0.2 mass %·g/m$^2$ or more, it may be 40.0 mass %·g/m$^2$ or less, and good conductivity is secured with 0.2 mass %·g/m$^2$ to 40 mass % of silver per g/m$^2$.

From these viewpoints, the silver content (the amount of silver coating) per unit specific surface area is preferably 0.2 to 40.0 mass %·g/m$^2$, more preferably 1.0 mass %·g/m$^2$ or more and 30.0 mass %·g/m$^2$ or less, even more preferably 2.0 mass %'g/m$^2$ or more and 20.0 mass %·g/m$^2$ or less.

D50

The silver-coated copper powder of the embodiment preferably has a central particle diameter D50, i.e., a volume cumulative particle diameter D50, of 0.5 μm to 20.0 μm as measured using a laser diffraction/scattering particle size distribution measurement apparatus. The network composed of larger conductive particles becomes sparser and can have lower conduction performance. With too small a particle size, an increased amount of silver will be needed to eliminate unevenness of silver coating, resulting in an economic waste.

Accordingly, the central particle diameter D50 of the silver-coated copper powder of the embodiment is preferably 0.5 μm to 20.0 μm, more preferably 1.0 μm or greater and 15.0 μm or smaller, even more preferably 2.0 μm or greater and 10.0 μm or smaller.

BET Specific Surface Area

The silver-coated copper powder of the embodiment preferably has a BET specific surface area (SSA) of, e.g., 0.30 m$^2$/g to 5.00 m$^2$/g. The shape of powder particles with an SSA much smaller than 0.30 m$^2$/g is close to the shape of a pine cone or a spherical shape with ungrown branches, which is not the dendritic shape as specified in the invention. Particles with an SSA much larger than 5.00 m$^2$/g tend to involve inconveniences when processed into, for example, conductive paste. For example, the branches (dendrites) are so thin that it may be difficult to disperse the dendritic particles to make paste without breaking off the branches, resulting in a failure to secure desired conductivity.

Accordingly, the specific surface area of the silver-coated copper powder of the embodiment as measured by the BET single-point method is preferably 0.30 to 5.00 m$^2$/g, more preferably 0.40 m$^2$/g or more and 4.00 m$^2$/g or less, even more preferably 1.00 m$^2$/g or more and 4.50 m$^2$/g or less, still even more preferably 3.00 m$^2$/g or less.

Tap Density (TD)

The silver-coated copper powder of the embodiment preferably has a tap density of 0.5 to 3.5 g/cm$^3$. The tap density of the silver-coated copper powder of the embodiment depends on the degree of dendritic growth. The dendritic silver-coated copper powder of the embodiment has a tap density as low as 3.5 g/cm$^3$ or even lower because of their high degree of dendritic growth. With a tap density of 0.5 g/cm$^3$ or higher, the silver-coated copper powder is easy to handle when processed into paste, and further improved conductivity will be obtained.

From these considerations, the tap density of the silver-coated copper powder of the embodiment is preferably 0.5 to 3.5 g/cm$^3$, more preferably 0.9 g/cm$^3$ or more and 3.0 g/cm$^3$ or less, even more preferably 1.0 g/cm$^3$ or more and 2.5 g/cm$^3$ or less, still even more preferably 2.0 g/cm$^3$ or less, yet even more preferably 1.5 g/cm$^3$ or less.

Method for Making Silver-Coated Copper Powder

An illustrative, non-limiting example of the method for making the silver-coated copper powder of the embodiment includes attaching a nitrogen-containing surface treating agent having an azo group to the surface of core copper particles and depositing a silver layer containing silver or a silver alloy on the thus surface-treated copper particles by displacement plating.

When core copper particles are coated with silver or a silver alloy by the above method, the individual particles of the resulting silver-coated copper powder have a shape almost directly reflecting that of the individual core copper particles.

Process for Making Core Copper Powder

The copper powder used as core particles is preferably a copper powder obtained by an electrolytic process, particularly an electrolytic copper powder having a dendritic shape with sufficiently grown branches as referred to earlier. Dendritic electrolytic copper powder with sufficiently grown branches is obtainable by an electrolytic process as described below.

The electrolytic process may be carried out by, for example, immersing an anode and a cathode in a sulfuric acid-acidic electrolytic solution containing copper ions, applying a direct electrical current between the anode and cathode to conduct electrolysis thereby to deposit powdery copper on the surface of the cathode. The deposited copper is recovered by mechanically or electrically scraping, washed, dried, and, if desired, sieved.

The electrolytic solution may preferably have a chlorine concentration adjusted to 3 to 300 mg/L, more preferably 5 to 200 mg/L, by addition of chlorine.

Examples of useful cathode plates include a copper, SUS, and Ti plate. Examples of useful anode plates include a copper and insoluble anode plate (DSE).

In the electrolytic production of copper, the copper ions in the electrolytic solution is consumed with the deposition of copper so that the copper ion concentration near the electrode plates gets thinner, and the electrolysis efficiency decreases. In order to maintain electrolysis efficiency, it has therefore been a usually followed practice to circulate the electrolytic solution in the electrolytic cell so as not to let the copper ion concentration of the electrolytic solution decrease between electrodes.

However, in order to have the dendrites of the individual copper particles grow, that is, in order to promote growth of branches of dendrites extending from the main stem, a lower copper ion concentration in the electrolytic solution near electrodes has turned out to be more effective. Then, it is preferred that, in electrolytic copper production, the copper ion concentration in the electrolytic solution near the electrodes be kept low by adjusting the size of the electrolytic cell, the number of electrode plates, the distance between the electrodes, and the amount of circulation of the electrolytic solution. The adjustment is preferably such that the copper ion concentration between the electrodes are made always thinner than at last the copper ion concentration at the bottom of the electrolytic cell.

The particle size of the dendritic copper particles is adjustable by property selecting the electrolysis conditions within the above described ranges on the basis of common knowledge in the art. When, for example, large size dendritic copper particles are desired, it is preferred that the copper concentration be set relatively high within preferred range, the current density be set relatively low within preferred range, and the electrolysis time be set relatively long within preferred range. When, on the other hand, small size dendritic copper particles are desired, the conditions are preferably decided in an opposite way. For example, the electrolysis may be carried out at a copper concentration of 1 g/L to 30 g/L and a current density of 100 $A/m^2$ to 4000 $A/m^2$ for a period of 3 minutes to 8 hours.

After completion of electrolysis, the deposited copper powder is preferably treated with an alkali to reduce its chlorine concentration as follows. The powder is washed with water where needed and then mixed with water to make a slurry or a powder cake. An alkali solution having a pH of 8 or higher is mixed with the slurry or cake, followed by, if necessary, stirring, thereby bringing the copper powder into contact with the alkali solution, followed by washing with water.

In carrying out the alkali treatment, the slurry or powder cake after the electrolytic copper deposition is preferably adjusted to a pH of 8 or higher, more preferably 9 or higher and 12 or lower, even more preferably 10 or higher and 11 or lower. Examples of the alkali agent that can be used in the alkali treatment include an ammonium carbonate solution, a caustic soda solution, sodium bicarbonate, potassium hydroxide, and aqueous ammonia.

Surface Treatment

In the production of the silver-coated copper powder of the embodiment, the thus obtained dendritic copper particles are preferably surface-treated by attaching to their surface a nitrogen-containing surface treating agent having an azo group.

When the hereinafter described formation of a silver layer on the copper particles by displacement plating is preceded by the attachment of a nitrogen-containing surface treating agent having an azo group to the surface of the copper particles, a predetermined amount of nitrogen (N) is successfully incorporated into the silver layer formed thereon, thereby allowing for increasing the conductivity with a reduced amount of silver.

In the case where benzotriazole (BTA), for example, is attached to the surface of the copper particles as a nitrogen-containing surface treating agent having an azo group, BTA is chemically bonded to the surface of the copper particles with its aromatic ring oriented to face outward. As a result, the surface of the particles is rendered hydrophobic, while the conductivity is expected to decrease. Nevertheless, when a silver layer containing a predetermined amount of N is formed on the copper particles, the conductivity increases even with a reduced amount of silver as stated supra. This effect is unpredictable and is not revealed until after implementation. Moreover, the fact that such an effect is not obtained with spherical copper particles is also unpredictable and is not revealed until after implementation.

The method for attaching the nitrogen-containing surface treating agent having an azo group to the surface of the copper particles is exemplified by, but not limited to, adding the nitrogen-containing surface treating agent to an aqueous slurry of the copper particles or mixing the copper particles and the nitrogen-containing surface treating agent in a V-mixer. The method by adding the nitrogen-containing surface treating agent to an aqueous slurry of the copper particles may be carried out by, for example, mixing an aqueous solution or slurry containing the copper particles with the nitrogen-containing surface treating agent thereby attaching the nitrogen-containing surface treating agent to the surface of the copper particles.

If necessary, the surface treatment may be preceded by removal of the surface oxide (oxide filth). For example, the core particles are put into water, followed by stirring, and a reducing agent such as hydrazine is added thereto and allowed to react while stirring. After the reaction, it is preferred to thoroughly wash the core particles to remove the reducing agent.

Coating with Silver

The method for coating the copper particles with silver or a silver alloy will next be described for illustrative purposes but not for limitation.

In what follows, displacement plating will be described as a preferred method for coating.

Displacement plating is preferable to reductive plating for the following reasons: silver or a silver alloy is made to coat the surface of the core copper particles more uniformly; the coated particles is less liable to agglomerate; and the cost is lower.

While in conventional displacement plating the resulting silver-coated copper powder has been recovered from the reaction solution by filtration followed by washing with water. However, because part of the copper ions are adsorbed onto the silver-coated copper powder, mere washing with water allows the adsorbed copper ions to remain on the surface of the particles. If the silver-coated copper particles with the remaining copper ions are dried as such, the copper ions are converted to copper oxide to form a copper oxide film on the surface of the particles.

To solve the above problem, washing can be conducted using a chelating agent, whereby re-adsorption of copper after displacement reaction is prevented, i.e., copper ions are inhibited from remaining on the surface of the particles. As a result, formation of a copper oxide film on the surface of the particles is prevented to ensure increased conductivity. It is recommended that the particles having been washed using a chelating agent be washed with, for example, pure water to exclude the possibility of the chelating agent remaining on the surface of the washed particles.

The chelating agent to be used may be at least one acid selected from aminocarboxylic acids, such as ethylenediaminetetraacetic acid (EDTA), diethylenetriaminepentaacetic acid, and iminodiacetic acid; hydroxyethylethylenediaminetriacetic acid, dihydroxyethylethylenediaminediacetic acid, and 1,3-propanediaminetetraacetic acid; or a salt thereof. Inter alia, EDTA or its salt is preferably used. When EDTA or a like chelating agent is used in the form of an acid (not in the form of a salt), it is preferably used in combination with an alkali, such as sodium hydroxide.

When a silver salt is added, the pH of the solution in which the displacement reaction is to occur is preferably adjusted to 3 to 4. Examples of the silver salt, which should be water-soluble to provide Ag ions, one or two selected from silver nitrate, silver perchlorate, silver acetate, silver oxalate, silver chlorate, silver hexafluorophosphate, silver tetrafluoroborate, silver hexafluoroarsenate, and silver sulfate, and mixtures thereof. The silver salt is preferably added in an amount equal to or greater than the theoretical equivalent, which corresponds to at least 2 moles, more preferably 2.1 moles or more of silver, per mole of copper when copper is used as a core material. With less than 2 moles of silver, displacement can be insufficient, resulting in the formation of silver particles having much copper remaining. Addition of 2.5 moles or more of silver is uneconomical.

The silver content of the silver-coated copper powder of the embodiment is adjustable by the amount of the silver salt added, the reaction time, the reaction rate, the amount of the chelating agent added, and so forth.

After completion of the displacement reaction, the silver powder particles are preferably washed thoroughly and dried.

Use

The silver-coated copper powder of the embodiment has excellent electrical conduction characteristics and is therefore suited for use as a main material composing conductive resin compositions, such as conductive paste and conductive adhesive, and other various conductive materials including conductive paint.

A conductive paste, for example, may be prepared by mixing the silver-coated copper powder of the embodiment with a binder, a solvent, and other optional components, such as a hardening agent, a coupling agent, and a corrosion inhibitor. Examples of useful binders include, but are not limited to, liquid epoxy resins, phenol resins, and unsaturated polyester resins. Examples of useful solvents include terpineol, ethyl carbitol, carbitol acetate, and butyl cellosolve. Examples of useful hardening agents include 2-ethyl-4-methylimidazole. Examples of useful corrosion inhibitors include benzothiazole and benzimidazole.

The conductive paste may be applied to a substrate patternwise to form electrical circuits of various types. For example, the conductive paste may be applied or printed on a fired or unfired substrate, heated, and baked with, if necessary, pressure applied thereto to form a printed circuit board or an electric circuit or an external electrode of various electronic components. The conductive paste is also useful in the formation of electromagnetic shielding films and bonding films.

Explanation of Words/Expressions

In the present Description, the expression "X to Y" (where X and Y are arbitrary numbers) means "from X to Y inclusive" unless specifically stated otherwise, and also encompasses the meaning "preferably greater than X" or "preferably less than Y".

Further, the expression "X or greater" (where X is an arbitrary number) encompasses the meaning "preferably greater than X" unless specifically stated otherwise, and the expression "Y or less" (where Y is an arbitrary number) encompasses the meaning "preferably less than Y" unless specifically stated otherwise.

EXAMPLES

The invention will now be illustrated in greater detail with reference to Examples, but it should be understood that the invention is not limited thereto.

Observation of Particle Shape:

The shape of any fifty of the silver-coated copper particles (sample) obtained in each of Examples and Comparative Examples was observed using a scanning electron microscope at a magnification of 5000. The shape of the copper particles which form at least 50% (at least 80% in the case of Examples and Comparative Examples given below) of the total number of the copper particles is shown in Table 1. In sample preparation for observation, a small amount of the copper powder was attached to carbon tape taking care such that the particles did not overlap each other.

Determination of Silver (Ag) Content:

The silver (Ag) content of the silver-coated copper powder (sample) obtained in Examples and Comparative Examples was determined by completely dissolving 1 g of the sample in a 1:1 nitric acid solution and titrated using sodium chloride to calculate the silver concentration. The results are shown in terms of Ag (wt %) in Tables 1 and 2.

Determination of Carbon (C) Content:

The carbon (C) content of the silver-coated copper powder (sample) obtained in Examples and Comparative Examples was determined by combusting 0.5 g of the sample on a carbon analyzer C744 from LECO Corp., detecting carbon dioxide in an infrared detector, and calculating the carbon content. The results are shown in terms of C (wt %) in Tables 1 and 2.

Determination of N Content:

The N content of the silver-coated copper powder (sample) obtained in Examples and Comparative Examples was determined by extracting 0.1 g of the sample on a nitrogen analyzer EMGA-820ST from Horiba, detecting nitrogen gas in a thermal conductivity detector, and converting the detected gas concentration to a nitrogen content. The results are shown in terms of N (wt %) in Tables 1 and 2.

Determination of BET Specific Surface Area:

The specific surface area of the silver-coated copper powder (sample) obtained in Examples and Comparative Examples was determined by the BET single-point method using Macsorb from Mountech Co., Ltd. The results are shown in terms of SSA ($m^2/g$) in Tables 1 and 2.

Determination of Particle Size:

A small amount of the silver-coated copper powder (sample) obtained in Examples and Comparative Examples was put in a beaker and wetted with two or three drops of a 3% Triton X solution (from Kanto Chemical Co., Inc.), and 50 mL of a 0.1% SN Dispersant 41 solution (from San Nopco Ltd.) was added thereto, followed by homogenization using an ultrasonic homogenizer US-300AT (from Nippon Seiki Co., Ltd.) at 200 W for 2 minutes to prepare a sample for analysis. The prepared sample was analyzed using a laser diffraction/scattering particle size distribution measurement apparatus MT3300 (form Nikkiso Co., Ltd.) to determine the volume cumulative central particle diameter D50.

Determination of Tap Density (TD):

The tap density ($g/cm^3$) of the silver-coated copper powder (sample) obtained in Examples and Comparative Examples was determined on 200 g of the powder using a powder tester PT-E (from Hosokawa Micron Corp.).

Determination of Powder Volume Resistivity:

The volume resistivity of the silver-coated copper powder (sample) obtained in Examples and Comparative Examples was determined using a powder resistivity measuring system PD-41 and a resistivity meter MCP-T600 (both available from Mitsubishi Chemical Analytec Co., Ltd.) as follows. Five grams of the ample was put in a probe cylinder, and the probe unit was set on PD-41. A load of 2 kN was applied to the sample using a hydraulic jack, and the resistivity of the sample under load was measured by the four-point probe method with MCP-T600. The volume resistivity was calculated from the measured resistance value and the sample thickness. The load applied was lower than usual to make the volume resistivity measuring conditions stricter.

Example 1

1.0 m×1.0 in of nine SUS-made cathode plates and nine insoluble anode plates (DSE from De Nora Permelec Ltd.)

were hung at a distance of 5 cm between them in an electrolytic cell measuring 2.5 m×1.1 m×1.5 m (ca. 4 $m^3$). A copper sulfate solution as an electrolytic solution was circulated in the cell at a rate of 30 L/min. A direct current was applied between the cathodes and anodes immersed in the solution to perform electrolysis thereby depositing powdery copper on the surface of the cathodes.

The Cu concentration of the circulating electrolytic solution were 10 g/L, sulfuric acid ($H_2SO_4$) concentration is 100 g/L, and chlorine concentration is 50 mg/L, respectively. The applied current density was 800 A/$m^2$. The electrolysis time was 30 minutes. The pH of the electrolytic solution was 1. During electrolysis, the copper ion concentration of the electrolytic solution was kept always lower between the electrodes than at the bottom of the cell.

The copper deposited on the surface of the cathodes was scraped off mechanically and washed to give water-containing copper powder cake corresponding to 5 kg of copper powder. The wet cake was suspended in 3 L of water to make a slurry, and an ammonium carbonate solution was added thereto while stirring until the pH of the slurry reached 9 to conduct alkali treatment. The alkali-treated copper powder was washed with pure water to remove impurities.

In 10 L of pure water was dissolved 25 g of benzotriazole (BTA) as a nitrogen-containing surface treating agent. Five kilograms of the resulting copper powder was put therein, followed by stirring to make the nitrogen-containing surface treating agent attach to the surface of the copper panicles. The thus treated copper powder was dried under reduced pressure ($1\times10^{-3}$ Pa) at 80° C. for 6 hours.

The resulting surface-treated electrolytic copper powder was observed using a scanning electron microscope (SEM) to find that at least 90% of the total number of the copper particles had a dendritic shape with a single main stem and a plurality of branches branched off vertically or obliquely from the main stein and grown three-dimensionally.

25 kg of the surface-treated electrolytic copper powder was put in 25 L of pure water maintained at 50° C., followed by thoroughly stirring. Separately, 2.3 kg of silver nitrate was put in 2.5 L of pure water to prepare a silver nitrate solution. The silver nitrate solution was added to the copper suspension prepared above all at once, followed by stirring for 2 hours to give a silver-coated copper powder slurry. The slurry was filtered in vacuo, and the filter cake was washed with a solution of 600 g of EDTA-2Na (disodium salt of ethylenediaminetetraacetic acid) in 6 L of pure water and then washed with 3 L of pure water to remove residual EDTA and dried at 90° C. for 3 hours to give a dendritic silver-coated copper powder (sample). The amount of the silver coating was 5.5 mass % relative to the total mass of the silver-coated copper powder.

The resulting dendritic silver-coated copper powder (sample) was observed using a scanning electron microscope (SEM) to find that at least 90% of the total number of the silver-coated copper particles had a dendritic shape with a single main stem and a plurality of branches branched off obliquely from the main stein and grown three-dimensionally.

Example 2

A dendritic silver-coated copper powder (sample) was obtained in the same manner as in Example 1, except that the silver nitrate solution, which was prepared by adding 2.3 kg of silver nitrate to 2.5 L of pure water, was replaced with a solution prepared by adding 4.5 kg of silver nitrate to 5 L of pure water.

The resulting dendritic silver-coated copper powder (sample) was observed using a scanning electron microscope (SEM) to find that at least 90% of the total number of the silver-coated copper particles had a dendritic shape with a single main stem and a plurality of branches branched off obliquely from the main stem and grown three-dimensionally.

Example 3

A dendritic silver-coated copper powder (sample) was obtained in the same manner as in Example 1, except that the sulfuric acid ($H_2SO_4$) concentration was changed to 80 g/L and chlorine concentration was changed to 100 mg/L of the circulating electrolytic solution, respectively, and that the silver nitrate solution, which was prepared by adding 2.3 kg of silver nitrate to 2.5 L of pure water, was replaced with a solution prepared by adding 4.5 kg of silver nitrate to 5 L of pure water.

The resulting dendritic silver-coated copper powder (sample) was observed using a scanning electron microscope (SEM) to find that at least 90% of the total number of the silver-coated copper particles had a dendritic shape with a single main stem and a plurality of branches branched off obliquely the main steam and grown three-dimensionally.

Example 4

A dendritic silver-coated copper powder (sample) was obtained in the same manner as in Example 1, except that the silver nitrate solution, which was prepared by adding 2.3 kg of silver nitrate to 2.5 L of pure water, was replaced with a solution prepared by adding 4.5 kg of silver nitrate to 5 L of pure water and that 50 g of benzotriazole (BTA) was dissolved in 10 L of pure water instead of dissolving 25 g of benzotriazole (BTA) in 10 L of pure water.

The resulting dendritic silver-coated copper powder (sample) was observed using a scanning electron microscope (SEM) to find that at least 90% of the total number of the silver-coated copper particles had a dendritic shape with a single main stem and a plurality of branches branched off obliquely from the main stem and grown three-dimensionally.

Example 5

A dendritic silver-coated copper powder (sample) was obtained in the same manner as in Example 1, except that the silver nitrate solution, which was prepared by adding 2.3 kg of silver nitrate to 2.5 L of pure water, was replaced with a solution prepared by adding 4.5 kg of silver nitrate to 5 L of pure water and that 40 g of benzotriazole (BTA) was dissolved in 10 L of pure water instead of dissolving 25 g of benzotriazole (BTA) in 10 L of pure water.

The resulting dendritic silver-coated copper powder (sample) was observed using a scanning electron microscope (SEM) to find that at least 90% of the total number of the silver-coated copper particles had a dendritic shape with a single main stem and a plurality of branches branched off obliquely from the main stem and grown three-dimensionally.

Example 6

A dendritic silver-coated copper powder (sample) was obtained in the same manner as in Example 1, except that the Cu concentration of the circulating electrolytic solution was changed to 15 g/L, that the silver nitrate solution, which was prepared by adding 2.3 kg of silver nitrate to 2.5 L of pure water, was replaced with a solution prepared by adding 4.5 kg of silver nitrate to 5 L of pure water, and that 50 g of BTA was dissolved in 10 L of pure water instead of dissolving 25 g of BTA in 10 L of pure water.

The resulting dendritic silver-coated copper powder (sample) was observed using a scanning electron microscope (SEM) to find that at least 90% of the total number of the silver-coated copper particles had a dendritic shape with a single main stem and a plurality of branches branched off obliquely from the main stem and grown three-dimensionally.

Example 7

A dendritic silver-coated copper powder (sample) was obtained in the same manner as in Example 1, except that the silver nitrate solution, which was prepared by adding 2.3 kg of silver nitrate to 2.5 L of pure water, was replaced with a solution prepared by adding 9.1 kg of silver nitrate to 10 L of pure water.

The resulting dendritic silver-coated copper powder (sample) was observed using a scanning electron microscope (SEM) to find that at least 90% of the total number of the silver-coated copper particles had a dendritic shape with a single main stem and a plurality of branches branched off obliquely from the main stem and grown three-dimensionally.

Example 8

A dendritic silver-coated copper powder (sample) was obtained in the same manner as in Example 1, except that the Cu concentration was changed to 15 g/L, sulfuric acid ($H_2SO_4$) concentration was changed to 80 g/L, and chlorine concentration of the circulating electrolytic solution were changed to 30 mg/L respectively, and that the silver nitrate solution, which was prepared by adding 2.3 kg of silver nitrate to 2.5 L of pure water, was replaced with a solution prepared by adding 4.5 kg of silver nitrate to 5 L of pure water.

The resulting dendritic silver-coated copper powder (sample) was observed using a scanning electron microscope (SEM) to find that at least 90% of the total number of the silver-coated copper particles had a dendritic shape with a single main stem and a plurality of branches branched off obliquely the main steam and grown three-dimensionally.

Example 9

A dendritic silver-coated copper powder (sample) was obtained in the same manner as in Example 1, except that the Cu concentration was changed to 15 g/L and chlorine concentration was changed to 10 mg/L of the circulating electrolytic solution respectively, that the electrolysis was carried out at a current density of 100 A/m$^2$ for 30 minutes, and that the silver nitrate solution, which was prepared by adding 2.3 kg of silver nitrate to 2.5 L of pure water, was replaced with a solution prepared by adding 4.5 kg of silver nitrate to 5 L of pure water.

The resulting dendritic silver-coated copper powder (sample) was observed using a scanning electron microscope (SEM) to find that at least 90% of the total number of the silver-coated copper particles had a dendritic shape with a single main stem and a plurality of branches branched off obliquely the main steam and grown three-dimensionally.

Examples 10 to 12

A dendritic silver-coated copper powder (sample) was obtained in the same manner as in Example 1, except that benzotriazole (BTA) was replaced with 1-[N,N-bis(2-ethylhexyl)aminomethyl]benzotriazole (BT-LX from Johoku Chemical Co., Ltd.), 2,2'-[[methyl-1H-benzotriazol-1-yl]methyl]imino]bisethanol (TT-LYK from Johoku Chemical Co., Ltd.), or 1-[N,N-bis(2-ethylhexyl)aminomethyl]methylbenzotriazole (TT-LX from Johoku Chemical Co., Ltd.).

The resulting dendritic silver-coated copper powder (sample) was observed using a scanning electron microscope (SEM) to find that at least 90% of the total number of the silver-coated copper particles had a dendritic shape with a single main stem and a plurality of branches branched off obliquely the main steam and grown three-dimensionally.

Comparative Example 1

A dendritic silver-coated copper powder (sample) was obtained in the same manner as in Example 2, except that the nitrogen-containing surface treating agent was not mixed into 10 L of pure water.

Comparative Example 2

A dendritic silver-coated copper powder (sample) was obtained in the same manner as in Example 8, except that the nitrogen-containing surface treating agent was not mixed into 10 L of pure water.

Comparative Example 3

A dendritic silver-coated copper powder (sample) was obtained in the same manner as in Example 9, except that the nitrogen-containing surface treating agent was not mixed into 10 L of pure water.

Comparative Example 4

A spherical silver-coated copper powder (sample) was obtained in the same manner as in Example 2, except that spherical copper particles with a D50 of 5.5 μm were used as core particles and that the nitrogen-containing surface treating agent was not mixed into 10 L of pure water.

Comparative Example 5

A spherical silver-coated copper powder (sample) was obtained in the same manner as in Example 2, except that the spherical copper particles with a D50 of 6.0 μm were used as core particles

TABLE 1

| Example | Shape | Core Surface Treatment | Ag (wt %) | C (wt %) | N (wt %) | N/Ag (parts by mass/ 100 parts by mass) | SSA ($m^2/g$) | Ag/SSA (mass % · $g/m^2$) | D50 (μm) | TD ($g/cm^3$) | Volume Resistivity at 2 kN (Ω · cm) |
|---|---|---|---|---|---|---|---|---|---|---|---|
| 1 | dendritic | BTA | 5.5 | 0.59 | 0.09 | 1.7 | 1.85 | 3.0 | 3.1 | 1.3 | 1.4E−04 |
| 2 | | | 10.2 | 0.31 | 0.12 | 1.1 | 1.87 | 5.5 | 3.1 | 1.6 | 1.1E−04 |
| 3 | | | 9.8 | 0.39 | 0.08 | 0.8 | 1.78 | 5.5 | 3.4 | 1.3 | 1.2E−04 |
| 4 | | | 10.1 | 0.51 | 0.27 | 2.7 | 2.90 | 3.5 | 2.9 | 1.1 | 1.4E−04 |
| 5 | | | 10.1 | 0.43 | 0.16 | 1.6 | 2.15 | 4.7 | 3.1 | 1.3 | 1.4E−04 |
| 6 | | | 10.1 | 0.55 | 0.25 | 2.5 | 2.01 | 5.0 | 4.0 | 1.9 | 1.4E−04 |
| 7 | | | 19.5 | 0.45 | 0.13 | 0.7 | 2.12 | 9.2 | 3.1 | 1.1 | 9.0E−05 |
| 8 | | | 10.5 | 0.19 | 0.08 | 0.7 | 1.02 | 10.3 | 6.4 | 1.0 | 8.3E−05 |
| 9 | | | 10.2 | 0.17 | 0.08 | 0.7 | 0.60 | 17.0 | 14.9 | 1.1 | 6.9E−05 |
| 10 | | BT-LX | 10.1 | 0.30 | 0.10 | 1.0 | 1.13 | 8.9 | 3.0 | 1.1 | 1.2E−04 |
| 11 | | TT-LYK | 10.3 | 0.30 | 0.08 | 0.8 | 1.05 | 9.8 | 2.9 | 1.1 | 1.3E−04 |
| 12 | | TT-LX | 10.1 | 0.27 | 0.08 | 0.8 | 1.08 | 9.4 | 3.2 | 1.2 | 1.3E−04 |

TABLE 2

| Comparative Examples | Shape | Core Surface Treatment | Ag (wt %) | C (wt %) | N (wt %) | N/Ag (parts by mass/ 100 parts by mass) | SSA ($m^2/g$) | Ag/SSA (mass % · $g/m^2$) | D50 (μm) | TD ($g/cm^3$) | Volume Resistivity at 2 kN (Ω · cm) |
|---|---|---|---|---|---|---|---|---|---|---|---|
| 1 | dendritic | non- | 10.3 | 0.31 | 0.006 | 0.1 | 1.26 | 8.2 | 3.4 | 1.6 | 4.2E−04 |
| 2 | | treated | 9.9 | 0.19 | 0.006 | 0.1 | 0.80 | 12.4 | 5.3 | 1.4 | 2.3E−04 |
| 3 | | | 10.0 | 0.05 | 0.002 | 0.02 | 0.45 | 22.2 | 13.9 | 1.3 | 2.0E−04 |
| 4 | spherical | | 10.2 | 0.06 | 0.002 | 0.02 | 0.21 | 48.6 | 5.3 | 4.9 | 3.8E−04 |
| 5 | | BTA | 9.9 | 0.18 | 0.08 | 0.8 | 0.46 | 21.5 | 5.7 | 4.0 | 4.0E−04 |

Consideration of Results:

The copper particles composing the dendritic silver-coated copper powders (sample) obtained in each of Examples 1 to 12 were copper particles coated with a silver layer containing silver or a silver alloy each having nitrogen (N) in the silver layer and containing 0.2 to 10.0 parts by mass of nitrogen (N) with respect to 100 parts by mass of silver content.

The silver-coated copper powders (samples) obtained in Examples 1 to 12 were analyzed by STEM-EDS mapping (see the FIG.). It was confirmed that nitrogen (N) was dispersively present in the silver layer in every sample.

From the comparison between Examples where the copper particles were surface-treated and Comparative Examples where the surface treatment was not conducted, it was confirmed that 90% or more of the total nitrogen (N) contained in the silver-coated copper powder was present in the silver layer.

The silver-coated copper powders mainly composed of dendritic silver-coated copper particles, i.e., dendritic silver-coated copper powders, in which nitrogen (N) is present in the silver layer, and which contain 0.2 to 10.0 parts by mass of nitrogen (N) with respect to 100 parts by mass of silver content as in Examples proved to have reduced initial resistance and increased conductivity as compared with Comparative Examples 1 to 4. In contrast, it was ascertained that the silver-coated copper powder mainly composed of spherical silver-coated copper particles, i.e., spherical silver-coated copper powder which contains a predetermined amount of nitrogen (N) as in Comparative Example 5 fails to have increased conductivity in spite of the presence of N.

It is considered that, with the case of dendritic silver-coated copper powders, some reaction occurs between silver and nitrogen (N) in the silver layer to bring about reduction in initial resistance and increase in conductivity. With the case of spherical silver-coated copper powders, it is considered that the presence of nitrogen (N) in the silver layer acts preferentially as an electrical resistance.

The invention claimed is:

1. A silver-coated copper powder comprising a copper particle having a surface thereof coated with a silver layer containing silver or a silver alloy, said copper particle having a dendritic shape, the amount of silver coating of the silver-coated copper powder per unit specific surface area being 0.2 to 20.0 mass % $g/m^2$, the silver-coated copper powder containing nitrogen (N) in the silver layer, and having a nitrogen (N) content of 0.2 to 10.0 parts by mass with respect to 100 parts by mass of the silver content of the silver-coated copper powder, and the silver-coated copper powder having a volume cumulative particle diameter D50 of 0.5 μm to 10.0 μm as determined using a laser diffraction/scattering particle size distribution measurement apparatus.

2. The silver-coated copper powder according to claim 1, having the nitrogen (N) content of 0.5 to 10.0 parts by mass with respect to 100 parts by mass of the silver content.

3. The silver-coated copper powder according to claim 1, having a specific surface area of 1.02 $m^2$ /g to 5.00 $m^2/g$.

4. The silver-coated copper powder according to claim 1, wherein the silver-coated copper particle contains nitrogen (N) dispersively in its silver layer as analyzed by STEM-EDS mapping.

5. The silver-coated copper powder according to claim 1, having a tap density of 0.5 to 3.5 $g/cm^3$.

6. The silver-coated copper powder according to claim 1, wherein the silver-coated copper particles having a dendritic shape account for more than 80% of the total number of the particles composing the silver-coated copper powder.

7. The silver-coated copper powder according to claim 1, which is obtained by attaching a nitrogen (N)-containing surface treating agent having an azo group to the surface of a copper particle and forming a silver layer containing silver or a silver alloy on the surface of the surface-treated copper particle by displacement plating.

8. The silver-coated copper powder according to claim 2, having a specific surface area of 1.02 $m^2/g$ to 5.00 $m^2/g$.

9. The silver-coated copper powder according to claim 2, wherein the silver-coated copper particle contains nitrogen (N) dispersively in its silver layer as analyzed by STEM-EDS mapping.

10. The silver-coated copper powder according to claim 3, wherein the silver-coated copper particle contains nitrogen (N) dispersively in its silver layer as analyzed by STEM-EDS mapping.

11. The silver-coated copper powder according to claim 2, having a tap density of 0.5 to 3.5 $g/cm^3$.

12. The silver-coated copper powder according to claim 3, having a tap density of 0.5 to 3.5 $g/cm^3$.

13. The silver-coated copper powder according to claim 4, having a tap density of 0.5 to 3.5 $g/cm^3$.

14. The silver-coated copper powder according to claim 2, wherein the silver-coated copper particles having a dendritic shape account for more than 80% of the total number of the particles composing the silver-coated copper powder.

15. The silver-coated copper powder according to claim 3, wherein the silver-coated copper particles having a dendritic shape account for more than 80% of the total number of the particles composing the silver-coated copper powder.

16. The silver-coated copper powder according to claim 4, wherein the silver-coated copper particles having a dendritic shape account for more than 80% of the total number of the particles composing the silver-coated copper powder.

17. The silver-coated copper powder according to claim 5, wherein the silver-coated copper particles having a dendritic shape account for more than 80% of the total number of the particles composing the silver-coated copper powder.

18. The silver-coated copper powder according to claim 2, which is obtained by attaching a nitrogen (N)-containing surface treating agent having an azo group to the surface of a copper particle and forming a silver layer containing silver or a silver alloy on the surface of the surface-treated copper particle by displacement plating.

19. The silver-coated copper powder according to claim 3, which is obtained by attaching a nitrogen (N)-containing surface treating agent having an azo group to the surface of a copper particle and forming a silver layer containing silver or a silver alloy on the surface of the surface-treated copper particle by displacement plating.

20. The silver-coated copper powder according to claim 4, which is obtained by attaching a nitrogen (N)-containing surface treating agent having an azo group to the surface of a copper particle and forming a silver layer containing silver or a silver alloy on the surface of the surface-treated copper particle by displacement plating.

* * * * *